US012728898B2

(12) United States Patent
Nußbaumer et al.

(10) Patent No.: US 12,728,898 B2
(45) Date of Patent: Sep. 8, 2026

(54) CIRCULAR CABLEWAY

(71) Applicant: Innova Patent GmbH, Wolfurt (AT)

(72) Inventors: Alexander Nußbaumer, Hittisau (AT); Gerd Dür, Bildstein (AT)

(73) Assignee: INNOVA PATENT GMBH, Wolfurt (AT)

( * ) Notice: Subject to any disclaimer, the term of this patent is extended or adjusted under 35 U.S.C. 154(b) by 364 days.

(21) Appl. No.: 18/532,487

(22) Filed: Dec. 7, 2023

(65) Prior Publication Data

US 2024/0190482 A1 Jun. 13, 2024

(30) Foreign Application Priority Data

Dec. 7, 2022 (AT) ..... A 50935/2022

(51) Int. Cl.
*B61B 12/02* (2006.01)
*B61B 1/02* (2006.01)
(Continued)

(52) U.S. Cl.
CPC ..... *B61B 12/022* (2013.01); *B61B 1/02* (2013.01); *B61B 7/00* (2013.01); *B61B 7/04* (2013.01); *B61B 12/026* (2013.01); *B61B 12/10* (2013.01)

(58) Field of Classification Search
CPC ..... B61B 12/022; B61B 7/00; B61B 7/04; B61B 12/00; B61B 12/026; B61B 12/10; B61B 1/02
See application file for complete search history.

(56) References Cited

U.S. PATENT DOCUMENTS 4,401,034 A * 8/1983 Gaudet ..... B61B 12/10 104/178
4,669,389 A * 6/1987 Tarassoff ..... B61B 7/04 104/178
(Continued)

FOREIGN PATENT DOCUMENTS

AT 519826 A1 * 10/2018 ..... B61B 10/005
AT 524021 B1 * 2/2022 ..... B61B 12/105
(Continued)

OTHER PUBLICATIONS

European Search Report dated May 14, 2024 issued in European Application No. 23214481.6.
(Continued)

*Primary Examiner* — Cheng Lin
(74) *Attorney, Agent, or Firm* — Husch Blackwell LLP

(57) ABSTRACT

A circulating conveyor includes a circulating guide section forming a closed loop, a first switchable guide element displaceable between a closed position, connecting a first entry guide section in an entry area of the first conveying section to the circulating guide section, and an open position, a second switchable guide element displaceable between a closed position, connecting a first exit guide section in an exit area of the first conveying section to the circulating guide section, and an open position, a third switchable guide element displaceable between a closed position, connecting a second entry guide section in an entry area of the second conveying section to the circulating guide section, and an open position, and a fourth switchable guide element displaceable between a closed position, connecting a second exit guide section in an exit area of the second conveying section to the circulating guide section, and an open position.

21 Claims, 2 Drawing Sheets

(51) Int. Cl.

| | |
|---|---|
| ***B61B 7/00*** | (2006.01) |
| ***B61B 7/04*** | (2006.01) |
| ***B61B 12/10*** | (2006.01) |

(56) References Cited

U.S. PATENT DOCUMENTS

| | | | | | |
|---|---|---|---|---|---|
| 5,172,640 | A * | 12/1992 | Cathiard | B61B 12/022 | 104/178 |
| 6,427,601 | B2 * | 8/2002 | Albrich | B61B 12/022 | 104/178 |
| 9,688,289 | B2 * | 6/2017 | Luger | B61B 7/02 | |
| 2007/0251407 | A1 * | 11/2007 | Gabriel | B61B 1/02 | 104/180 |
| 2008/0229966 | A1 * | 9/2008 | Luger | B61B 12/022 | 104/173.1 |
| 2012/0266776 | A1 * | 10/2012 | Peterson | B60L 13/03 | 105/149.2 |

FOREIGN PATENT DOCUMENTS

| | | | | | |
|---|---|---|---|---|---|
| DE | 102010052094 | B4 * | 4/2020 | B61B 12/022 | |
| EP | 0179708 | A1 | 4/1986 | | |
| EP | 0491632 | A1 | 6/1992 | | |
| EP | 2331379 | A1 | 6/2011 | | |
| FR | 2773758 | A1 * | 7/1999 | B61B 12/10 | |
| FR | 2933359 | A1 * | 1/2010 | B61B 7/04 | |
| JP | H01175560 | A | 7/1989 | | |
| JP | 2009023413 | A | 2/2009 | | |
| WO | 2011003812 | A2 | 1/2011 | | |
| WO | WO-2012131197 | A1 * | 10/2012 | B61B 12/026 | |

OTHER PUBLICATIONS

Office Action dated Sep. 4, 2023 for Austrian Patent Application No. A50935/2022.
Machine Translation of WO2012131197A1.
Machine Translation of WO2011003812A2.
Machine Translation of JP2009023413A.
Machine Translation of FR2933359A1.
Machine Translation of JPH01175560A.
Machine Translation of AT519826A1.
Machine Translation of EP0492632A1.
Machine Translation of EP017908A1.

* cited by examiner

CIRCULAR CABLEWAY

CROSS REFERENCE

The application claims the benefit of priority based on Austrian Patent Application No. A50935/2022, filed on Dec. 7, 2022, the disclosure of which is hereby expressly incorporated by reference herein in their entireties.

TECHNICAL FIELD

The present disclosure relates to a circular cableway with a first conveying section which has a first conveyor cable, and with a second conveying section which has a second conveyor cable, and with a connecting station which connects the two conveying sections, wherein the first conveyor cable is deflected in the connecting station around a first cable sheave and the second conveyor cable is deflected in the connecting station around a second cable sheave, wherein a plurality of cableway vehicles are provided which are movable by the conveyor cables in the conveying sections, wherein a connecting guide device is provided in the connecting station along which cableway vehicles decoupled from the first conveyor cable in an entry area of the first conveying section can be moved to an exit area of the first conveying section or to an exit area of the second conveying section, and along which cableway vehicles decoupled from the second conveyor cable in an entry area of the second conveying section can be moved to the exit area of the second conveying section or to the exit area of the first conveying section. The present disclosure further relates to a method for operating a circular cableway.

BACKGROUND

Circular cableways having a plurality of, in particular two, conveying sections are known in the prior art. This is also referred to as a multi-section cableway. For each conveying section, a separate conveyor cable is provided which forms a closed cable loop along which a plurality of cableway vehicles can be moved in a known manner. A first conveying section generally connects a first end station to a central station, and a second conveying section connects the central station to a second end station. The central station acts as a connecting station for selective connection of the two conveying sections. Such circular cableways can be operated in different operating modes.

For example, only one conveying section can be in operation while the other conveying section is out of operation. In this case, only the cableway vehicles can be moved in the active conveying section by means of the corresponding conveyor cable, while the cableway vehicles of the deactivated conveying section are at a standstill. However, both conveying sections can also be in operation simultaneously. In this case, the two conveying sections can be connected to one another via the connecting station, for example, so that the cableway vehicles can be moved from the first end station of the first conveying section via the connecting station to the second end station of the second conveying section, similar to a single long circular cableway. With a corresponding design of the circular cableway, however, both conveying sections could also be in operation separately from one another so that the cableway vehicles are each moved only in the first or second conveying section. A number of cableway vehicles can therefore be moved along the closed cable loop of the first conveying section formed by the first conveyor cable between the first cableway station and the connecting station, and a number of cableway vehicles can be moved along the closed cable loop of the second conveying section formed by the second conveyor cable between the connecting station and the second cableway station, similar to two separate circular cableways.

A multi-section cableway therefore has the advantage that operation can be adapted very flexibly to given boundary conditions, e. g., weather or passenger volume.

AT 519826 A1 discloses, for example, a multi-section cableway with a connecting station, wherein a first cable loop forms a first route along which cableway vehicles are movable, and a second cable loop forms a second route along which cableway vehicles are movable. The two cable loops are connected within the connecting station by means of a connecting guide device which has four switches. This allows the aforementioned operating modes to be realized. However, it is disadvantageous that the connecting station has a relatively large length in the direction of movement, so that the connecting station cannot be used at unfavorable points under certain circumstances.

It is therefore an object of the present disclosure to provide a multi-section circular cableway with a more compact connecting station.

SUMMARY

The object is achieved according to the present disclosure in that a circulating guide section is provided in the connecting guide device, which forms a closed conveying loop along which the cableway vehicles can be moved, that a first switchable guide element is provided which can be displaced between a closed position in which it connects a first entry guide section of the connecting guide device provided in the entry area of the first conveying section to the circulating guide section, and an open position, that a second switchable guide element is provided which is displaceable between a closed position, in which it connects a first exit guide section of the connecting guide device provided in the exit area of the first conveying section to the circulating guide section, and an open position, that a third switchable guide element is provided which can be displaced between a closed position, in which it connects a second entry guide section of the connecting guide device provided in the entry area of the second conveying section to the circulating guide section, and an open position, and that a fourth switchable guide element is provided which can be displaced between a closed position, in which it connects a second exit guide section of the connecting guide device provided in the exit area of the second conveying section to the circulating guide section, and an open position. A connecting station is thereby created which can be constructed significantly shorter than known comparable connecting stations. The circulating guide section substantially functions as a central roundabout via which the cableway vehicles can be moved in a desired direction.

Preferably, a control unit for controlling the circular cableway is provided, and each switchable guide element has an actuating device which can be actuated by the control unit in order to displace the particular switchable guide element between the closed position and the open position. In this case, the actuating devices of the switchable guide elements preferably each have at least one of the following electrically actuatable actuators: hydraulic cylinders, pneumatic cylinders, and electric motors. This allows a desired switching position of the switchable guide elements to be controlled centrally and preferably automatically via the control unit of the cableway. The mentioned actuators enable proven and reliable generation of a sufficient actuating force.

The control unit is preferably designed to operate the circular cableway in a first conveying operating mode in which the actuating devices of the first switchable guide element and the second switchable guide element are controlled in such a way that the first switchable guide element and the second switchable guide element are each in the closed position, and the actuating devices of the third switchable guide element and the fourth switchable guide element are actuated in such a way that the third switchable guide element and the fourth switchable guide element are each in the open position. Alternatively or additionally, the control unit is preferably designed to operate the circular cableway in a second conveying operating mode in which the actuating devices of the first switchable guide element and the second switchable guide element are actuated in such a way that the first switchable guide element and the second switchable guide element are each in the open position, and the actuating devices of the third switchable guide element and the fourth switchable guide element are actuated in such a way that the third switchable guide element and the fourth switchable guide element are each in the closed position. Alternatively or additionally, the control unit is preferably designed to operate the circular cableway in a third conveying operating mode in which the actuating devices of all four switchable guide elements are actuated in such a way that they are each in the closed position. As a result, in the first conveying operating mode, just the first conveying section can be operated, and the second conveying section can be deactivated. Similarly, in the second conveying operating mode, just the second conveying section can be operated, and the first conveying section can be deactivated. In the third conveying operating mode, the full length of both conveying sections can be used in that the two conveying sections are connected and operated simultaneously. Very flexible operation of the cableway is therefore possible, wherein only those parts are operated that are required for the current operation.

According to a further advantageous embodiment of the present disclosure, the control unit can be designed to operate the circular cableway in a fourth conveying operating mode in which the actuating devices of the first switchable guide element and the second switchable guide element are controlled in such a way that the first switchable guide element and the second switchable guide element are each in the closed position, and the actuating devices of the third switchable guide element and the fourth switchable guide element are controlled in such a way that the third switchable guide element and the fourth switchable guide element are each moved cyclically between the closed position and the open position so that alternatingly, a number of consecutive cableway vehicles can be moved from the first conveying section via the fourth switchable guide element in the closed position into the exit area of the second conveying section, and at least one cableway vehicle immediately following the number of cableway vehicles can be moved into the exit area of the first conveying section along a part of the circulating guide section, wherein $n \in \mathbb{N}$ with $\mathbb{N} \geq 1$. As a result, both conveying sections can be operated like in the third conveying operating mode. In contrast to the third conveying operating mode, however, the number of cableway vehicles and therefore the conveying capacity can be increased in the first conveying section and reduced in the second conveying section. If, for example, n=1 is used, then every second cableway vehicle in the first conveying section can be moved back into the first conveying section and inserted between two cableway vehicles in the second conveying section. If n=2, then every third cableway vehicle can be returned, if n=3, each fourth cableway vehicle, etc.

Additionally or alternatively, the control unit can also be designed to operate the circular cableway in a fifth conveying operating mode in which the actuating devices of the third switchable guide element and the fourth switchable guide element are controlled in such a way that the third switchable guide element and the fourth switchable guide element are each in the closed position, and the actuating devices of the first switchable guide element and the second switchable guide element are controlled in such a way that the first switchable guide element and the second switchable guide element are each moved cyclically between the closed position and the open position so that alternatingly, a number of consecutive cableway vehicles can be moved from the second conveying section via the second switchable guide element in the closed position into the exit area of the first conveying section, and at least one cableway vehicle immediately following the number of cableway vehicles can be moved into the exit area of the second conveying section along a part of the circulating guide section, wherein $n \in \mathbb{N}$ with $\mathbb{N} \geq 1$. As a result, both conveying sections can be operated similarly to the third conveying operating mode. In contrast to the third conveying operating mode, however, in this case the number of cableway vehicles and therefore the conveying capacity can be increased in the second conveying section and reduced in the first conveying section, i.e. substantially vice versa, as in the fourth conveying operating mode.

Preferably, at least one sensor unit for detecting a switching state is provided for each of the switchable guide elements, and the control unit is designed to control the circular cableway depending on the switching states.

Preferably, the control unit is designed to operate the circular cableway in the first conveying operating mode when the sensor units provided for the first and second switchable guide elements each determine a sensor variable representative of the closed position, and the sensor units provided for the third and fourth switchable guide elements each determine a sensor variable representative of the open position. Alternatively or additionally, the control unit is preferably designed to operate the circular cableway in the second conveying operating mode when the sensor units provided for the first and second switchable guide elements each determine a sensor variable representative of the open position, and the sensor units provided for the third and fourth switchable guide elements each determine a sensor variable representative of the closed position. Alternatively or additionally, the control unit is preferably designed to operate the circular cableway in the third conveying operating mode when the sensor units of all four switchable guide elements each determine a sensor variable representative of the closed position. This can increase operational safety since the particular operating mode is only carried out when it is ensured that none of the relevant switchable guide elements is still in the open state. The sensor units can, for example, comprise electrical switches which close or interrupt a circuit in order to detect the closed position or the open position. Other suitable sensors can also be used to detect the switching state, such as capacitive sensors or inductive sensors, magnetic sensors or optical sensors.

Preferably, a first drive device for driving the first conveyor cable of the first conveying section and a second drive device for driving the second conveyor cable of the second conveying section are provided, and the control unit is designed to activate the first drive device and to deactivate the second drive device in the first conveying operating mode, and/or to activate the second drive device and deactivate the first drive device in the second conveying operating mode, and/or to activate the first drive device and the second drive device in the third, fourth and fifth conveying operating mode. As a result, only the drive device relevant to the particular operating mode can be operated automatically.

Advantageously, an auxiliary drive is also provided in the connecting station for moving the cableway vehicles decoupled from the conveyor cables along the connection guide device, wherein the control unit is designed to control the auxiliary drive in the first conveying operating mode in such a way that the cableway vehicles decoupled from the first conveyor cable of the first conveying section can be moved from the first entry guide section via a first part of the circulating guide section to the first exit guide section of the first conveying section, to control it in the second conveying operating mode in such a way that the cableway vehicles decoupled from the second conveyor cable of the second conveying section can be moved from the second entry guide section via a second part of the circulating guide section to the second exit guide section of the second conveying section, and to control it in the third conveying operating mode in such a way that the cableway vehicles decoupled from the first conveyor cable of the first conveying section can be moved from the first entry guide section via a third part of the circulating guide section to the second exit guide section of the second conveying section, and the cableway vehicles decoupled from the second conveyor cable of the second conveying section can be moved from the second entry guide section via a fourth part of the circulating guide section to the first exit guide section of the first conveying section.

In this way, only the part of the auxiliary drive relevant to a conveying operating mode can be activated in each case. The auxiliary drive can, for example, comprise a known tire conveyor, chain conveyor, or belt conveyor. A tire conveyor has, in a known manner, a plurality of driven friction wheels arranged one behind the other in the direction of movement along the guide device. The friction wheels interact with a friction lining of a cableway vehicle in order to drive the cableway vehicle decoupled from the conveyor cable. A chain conveyor has a driven chain on which a plurality of drivers are arranged. The drivers interact with a component of the cableway vehicle, for example a cable clamp, in order to drive the cableway vehicle. A belt conveyor has a driven belt on which a plurality of drivers are arranged. The drivers interact with a component of the cableway vehicle, for example a cable clamp, in order to drive the cableway vehicle. A combination of different embodiments is of course also possible. For example, a chain or belt conveyor could be provided for the movement from an entry guide section to the circulating guide section, or from the circulating guide section up to an exit guide section, and a belt conveyor for the movement along the circulating guide section.

According to a preferred embodiment, the circulating guide section is circular, oval or elliptical and preferably has a geometrically continuous curvature profile, particularly preferably with a G2 continuity. The shape of the circulating guide section can therefore be adapted to the existing space in the connecting station, for example, and substantially jerk-free movement along the circulating guide section can be enabled. The entire guide device preferably has a (G2) continuous curvature profile so that jerk-free movement is also possible in the transition from the entry guide sections to the circulating guide section or from the circulating guide section to the exit guide sections. This increases the comfort and also reduces the wear.

In an advantageous embodiment, the circulating guide section has a first curved section and an opposite second curved section, wherein a convex side of the first curved section of the first cable sheave faces the first conveying section, and a convex side of the second curved section of the second cable sheave faces the second conveying section. In addition, the circulating guide section preferably has a first straight section and an opposite, parallel second straight section which connect the curved sections in order to form the closed conveying loop, wherein the first switchable guide element and the fourth switchable guide element are connected to the first straight section in the closed position, and the second switchable guide element and the third switchable guide element are connected to the second straight section in the closed position. The curved sections are preferably designed as circular arc sections, and the switchable guide elements are preferably each connected to the associated entry guide section or exit guide section so as to be pivotable about an axis. A preferred embodiment is thereby provided which enables a very compact design.

These and other aspects are merely illustrative of the innumerable aspects associated with the present disclosure and should not be deemed as limiting in any manner. These and other aspects, features, and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the present disclosure and wherein similar reference characters indicate the same parts throughout the views.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

In the following detailed description numerous specific details are set forth in order to provide a thorough understanding of the present disclosure. However, it will be understood by those skilled in the art that the present disclosure may be practiced without these specific details. For example, the present disclosure is not limited in scope to the particular type of industry application depicted in the figures. In other instances, well-known methods, procedures, and components have not been described in detail so as not to obscure the present disclosure.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

Figure 1:
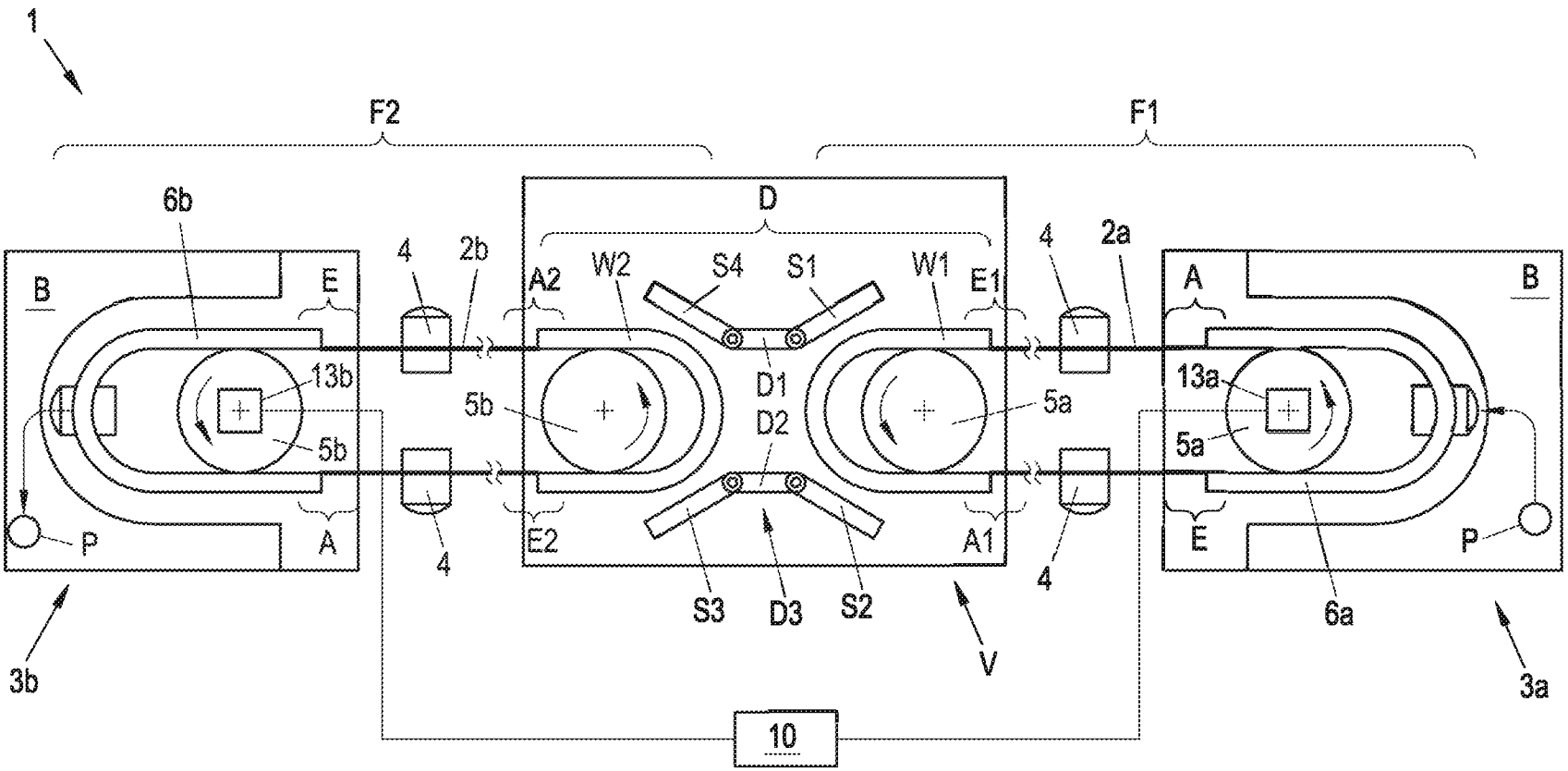
FIG. 1 shows a circular cableway with a connecting station according to the prior art.

FIG. 1 shows a schematically represented circular cableway 1 in the form of a multi-section way according to the prior art. The circular cableway 1 serves to illustrate the general mode of operation. The term cableway 1 is used synonymously below for circular cableway 1 for the sake of simplicity. The cableway 1 has a first conveying section F1 with a first conveyor cable 2*a* and a second conveying section F2 with a second conveyor cable 2*b*. The first conveying section F1 has a first cableway station 3*a* which is designed as an end station, and the second conveying section F2 has a second cableway station 3*b* which is also designed as an end station. The first cableway station 3*a* could, for example, be a valley station in a valley of a ski resort, and the second cableway station 3*b* could be a mountain station on a mountain of the ski resort, or vice versa. In this case, passengers would predominantly be transported from the valley to the mountain. Increasingly, however, cableways 1 also are used in an urban setting as public means of transport. In this case, passengers can be transported substantially equally in both directions. A slope does not necessarily have to be provided; transportation could also be in a plane, for example.

Furthermore, connecting station V arranged between the first cableway station 3*a* and the second cableway station 3*b* is provided which connects the two conveying sections F1, F2. The first conveyor cable 2*a* of the first conveying section F1 is deflected around a first cable sheave 5*a* in the first cableway station 3*a* and in the connecting station V in order to form a closed cable loop. In the same way, the second conveyor cable 2*a* of the second conveying section F2 is deflected around a second cable sheave 5*b* in the second cableway station 3*b* and in the connecting station V in order to form a closed cable loop. Furthermore, a plurality of preferably identical cableway vehicles 4 are provided in the cableway 1. On the one hand, a number of cableway vehicles 4 can be moved with the first conveyor cable 2*a* in the first conveying section F1, and a number of cableway vehicles 4 can be moved with the second conveyor cable 2*b* in the second conveying section F2. On the other hand, the two conveying sections F1, F2 can be connected by the connecting station, whereby the two conveyor cables 2*a*, 2*b* substantially form a long cable loop along which the cableway vehicles 4 can be moved between the two end stations 3*a*, 3*b*. The cableway vehicles 4 in this case are designed as cabin vehicles, for example, and each have a cabin for accommodating persons and/or objects. In principle, however, chair vehicles could also be used, for example, which each have a chair for accommodating persons.

A first guide device 6*a* is provided within the first cableway station 3*a*. The cableway vehicles 4 can be decoupled from the first conveyor cable 2*a* in an entry area E of the first cableway station 3*a* and can be moved along the first guide device 6*a* parallel to a platform B at a reduced speed relative to the first conveyor cable 2*a* to the exit area A of the first cableway station 3*a*. The first guide device 6*a* therefore serves to turn the cableway vehicles 4. In the same way, a second guide device 6*b* for turning the cableway vehicles 4 is provided within the second cableway stations 3*b*. The cableway vehicles 4 can in turn be decoupled from the second conveyor cable 2*b* in an entry area E of the second cableway station 3*b* and can be moved along the second guide device 6*b* parallel to a platform B at a reduced speed relative to the second conveyor cable 2*b* to the exit area A of the second cableway station 3*b*. Passengers P can enter or exit the cableway vehicles 4 via the platforms B, as indicated by the arrows in FIG. 1.

A connection guide device D is provided in the connecting station V for connecting the two conveying sections F1, F2. The connection guide device D has a first turning section W1 for the first conveying section F1 and a second turning section W2 for the second conveying section F2. The first turning section W1 is designed substantially the same as the first guide device 6*a* of the first cableway station 3*a*, and the second turning section W2 is designed substantially the same as the second guide device 6*b* of the second cableway station 3*b*. Furthermore, the connection guide device D has a first passage guide section D1 and a second passage guide section D2 which are arranged here at a distance from and parallel to one another transversely to the direction of movement of the cableway vehicles 4.

In addition, four switchable guide elements S1-S4 are provided which are each displaceable between an open position (shown in FIG. 1) and a closed position (not shown). The switchable guide elements S1–S4 serve as switches for the cableway vehicles 4. If the guide elements S1+S4 are each in the closed position, then the first turning section W1 and the second turning section W2 are connected via the first passage guide section D1 so that cableway vehicles 4 can be transferred from the first conveying section F1 to the second conveying section F2. If the guide elements S2+S3 are each in the closed position, then the first turning section W1 and the second turning section W2 are connected via the second passage guide section D1, so that cableway vehicles 4 can be transferred from the second conveying section F2 to the first conveying section F1.

If the switchable guide elements S1-S4 are open, then both conveying sections F1, F2 can, for example, be operated independently of one another. Alternatively, however, only one of the two conveying sections F1, F2 could also be operated, while each of the other conveying sections F1, F2 is out of operation. The cableway vehicles 4 of the first conveying section F1 can then be moved from the entry area E1 of the connecting station V provided for the first conveying section F1 via the first turning section W1 to the exit area A1 of the connecting station V provided for the first conveying section F1. In the same way, the cableway vehicles 4 of the second conveying section F2 can be moved from the entry area E2 of the connecting station V provided for the second conveying section F2 via the first turning section W1 from the exit area A2 of the connecting station V provided for the second conveying section F2.

To detachably couple to the conveyor cables 2*a*, 2*b*, the cableway vehicles 4 each have a cable clamp (not shown) in a known manner. The cable clamps are usually pretensioned in the closed state by a pretensioning device, e.g. comprising a number of springs, and can be actuated to open in the entry areas E, E1, E2 and in the exit areas A, A1, A2 by suitable stationary actuating devices (not shown) against the pretensioning force of the pretensioning device. Such cable clamps are known in the prior art, which is why no further explanation is given here. One or more guide rollers with which the cableway vehicles 4 can roll along the guide devices 6*a*, 6*b*, D are generally also arranged in the region of the cable clamps.

Of course, a suitable drive device is also provided in the cableway 1 to drive the cableway vehicles 4. The drive device comprises at least one first drive unit 13*a*, for example in the form of an electrical machine for driving the first conveyor cable 2*a*, and at least one second drive unit 13*b*, for example in the form of an electrical machine for driving the second conveyor cable 2*b*. The first drive unit 13*a* can, for example, be arranged in the first cableway station 2*a* and be designed to drive the first cable sheave 5*a*, and the second drive unit 13*b* can be arranged, for example, in the second cableway station 2*b* and be designed to drive the second cable sheave 5*b*. Alternatively or additionally, however, the first drive unit 13*a* and the second drive unit 13*b* could also be arranged in the connecting station V, for example, and be designed to drive the first cable sheave 5*a* or the second cable sheave 5*b*.

In the first and second cableway stations 3*a*, 3*b* and the connecting station V, a suitable auxiliary drive (not shown) is furthermore provided in order to move the cableway vehicles 4 decoupled from the particular conveyor cable 2*a*, 2*b* along the first or second guide device 6*a*, 6*b* or along the connection guide device D. The drive device therefore preferably also comprises drive units for driving the auxiliary drives. The auxiliary drives can be designed in a known manner and, for example, each have a plurality of driven friction wheels which are arranged one behind the other along the particular guide device 6*a*, 6*b*, D. To drive the cableway vehicles 4, the friction wheels interact with friction linings which are provided on the cableway vehicles 4, for example on the cable clamps. A chain conveyor can also be used as an auxiliary drive in a known manner.

Furthermore, a suitable control device 10 is also provided in the cableway 1 and is designed to control the cableway 1, in particular the drive device. The control device 10 can have suitable hardware and/or software and can be provided, for example, in one of the cableway stations 3*a*, 3*b* or in the connecting station V. The control device 10 could of course also comprise a plurality of separate control units which communicate with one another. This sufficiently describes the basic structure and function of the multi-section circular cableway 1. The cableway 1 according to the present disclosure is explained in more detail below with reference to FIG. 2.

Figure 2:
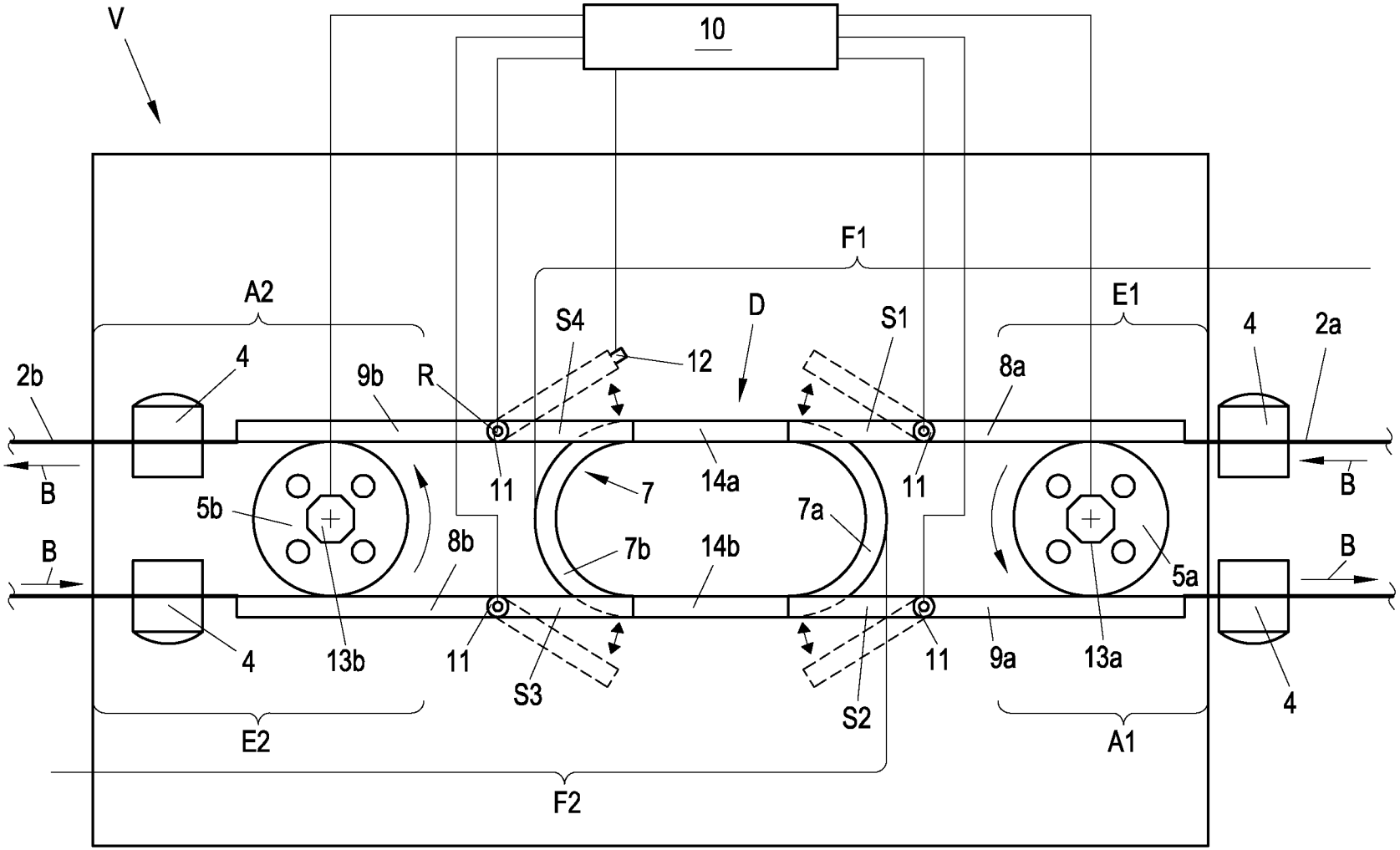
FIG. 2 shows a connecting station of a circular cableway in an exemplary embodiment of the present disclosure.

For the sake of simplicity, only the connecting station V of the cableway 1 is shown in FIG. 2. The first cableway station 3*a* and the second cableway station 3*b* are not shown and can be designed essentially as shown in FIG. 1. The first drive unit 13*a* for driving the first cable sheave 5*a* and the second drive unit 13*b* for driving the second cable sheave 5*b* are provided here by way of example in the connecting station V. The two drive units 13*a*, 13*b* are part of the entire drive device and can be controlled by the control unit 10. The conveying speed of the conveyor cables 2*a*, 2*b* can therefore be set via the control unit 10. In the connecting station V, a connection guide device D is also provided which differs from the known connection guide device D according to FIG. 1, as will be described in detail below.

A circulating guide section 7 for connecting the two conveying sections F1, F2, which forms a closed conveying loop along which the cableway vehicles 4 can be moved, is provided in the connection guide device D. Furthermore, a first entry guide section 8*a*, a first exit guide section 9*a* and a second entry guide section 8*b* and a second exit guide section 9*b* are provided in the connection guide device D. The first entry guide section 8*a* is arranged in the entry area E1 of the first conveying section F1, and the first exit guide section 9*a* is arranged in the exit area A1 of the first conveying section F1. In the same way, the second entry guide section 8*b* is arranged in the entry area E2 of the second conveying section F2, and the second exit guide section 9*a* is arranged in the exit area A2 of the second conveying section F2. As can be seen in FIG. 2, the two conveying sections F1, F2 overlap in the longitudinal direction, while the conveying sections F1, F2 in FIG. 1 are spaced apart from one another. As a result, the connecting station V of the present disclosure can be constructed significantly shorter than before.

Furthermore, a first switchable guide element S1 is provided in the connection guide device D and is displaceable between a closed position, in which it connects the first entry guide section 8*a* to the circulating guide section 7, and an open position. In addition, a second switchable guide element S2 is provided which is displaceable between a closed position, in which it connects the first exit guide section 9*a* to the circulating guide section 7, and an open position. In the same way, a third switchable guide element S3 and a fourth switchable guide element S4 are provided. The third switchable guide element S3 is displaceable between a closed position, in which it connects the second entry guide section 8*b* to the circulating guide section 7, and an open position, and the fourth switchable guide element S4 is displaceable between a closed position, in which it connects the second exit guide section 9*b* to the circulating guide section 7, and an open position. The switching elements S1-S4 in turn act as switches for the cableway vehicles 4.

Each switchable guide element S1-S4 preferably has an actuating device 11 which can be actuated by the control unit 10 of the cableway 1 in order to displace the particular switchable guide element S1-S4 between the closed position and the open position. The actuating devices 11 of the switchable guide elements S1-S4 can, for example, each have at least one of the following electrically actuatable actuators: hydraulic cylinders, pneumatic cylinders or electric motors. According to a preferred embodiment, either 400 V three-phase motors or 24 V DC motors are used.

The circulating guide section 7 substantially forms a central roundabout that is between the first conveying section F1 and the second conveying section F2. Both conveying sections F1, F2 can therefore each use a part of the circulating guide section 7 as a turning section, whereby the connection guide device D and consequently the connecting station V can be constructed more compactly compared to the prior art (according to FIG. 1). Depending on the available space in the connecting station V, the circulating guide section 7 can, for example, be circular, oval or elliptical. In order to increase the comfort for passengers and reduce the wear on the cableway vehicles 4, for example on the guide rollers or on bearings of the guide rollers, and/or the wear on the connection guide device D, the circulating guide section 7 preferably has a geometrically continuous curvature profile, preferably with a G2 continuity. This allows the cableway vehicles 4 to move without jerks along the circulating guide section 7.

In the shown example, the circulating guide section 7 has a first curved section 7*a* and an opposite second curved section 7*b* which are designed here as circular arc sections. A convex side of the first curved section 7*a* faces the first cable sheave 5*a* of the first conveying section F1 and faces a convex side of the second curved section 7*b* of the second pulley 5*b* of the second conveying section F2. Furthermore, the circulating guide section 7 here has a first straight section 14*a* and an opposite parallel second straight section 14*b* which connects the ends of the curved sections 7*a*, 7*b* to one another in order to form the closed conveying loop. In the closed position, the first switchable guide element S1 and the fourth switchable guide element S3 are connected to the first straight section 14*a*. In the closed position, the second switchable guide element S2 and the third switchable guide element S3 are connected to the second straight section 14*b*.

The switchable guide elements S1-S4 can, for example, each be connected to the associated entry guide section 8*a*, 8*b* or exit guide section 9*a*, 9*b* so as to be pivotable about a, for example vertical, axis R. The switchable guide elements S1-S4 can therefore be pivoted by the associated actuating devices 11 about the particular axis R selectively and individually between the open position (indicated by dashed lines in FIG. 2) and the closed position. For the sake of simplicity, the axis R is only indicated for the fourth switchable guide element S4. Of course, the shown embodiment is only exemplary, and the switchable guide elements S1-S4 could also be designed differently. For example, translationally movable switchable guide elements S1-S4, which can be inserted by suitable actuating devices 11 into a free space provided in the movement direction between the entry guide sections 8*a*, 8*b* or exit guide sections 9*a*, 9*b*, and the circulating guide section 7, would also be conceivable.

As was mentioned above with reference to FIG. 1, a suitable auxiliary drive (not shown) is also provided, with which the cableway vehicles 4 decoupled from the conveyor cables 2*a*, 2*b* can be moved in a desired direction along the connection guide device D. The auxiliary drive can have one or more auxiliary drive units which can also be controlled by the control unit 10. For example, the auxiliary drive can have a tire conveyor or a chain conveyor or a combination of different types of conveyors. A tire conveyor could, for example, be provided for the entry guide sections 8*a*, 8*b* and for the exit guide sections 9*a*, 9*b* in order to move the cableway vehicles 40. In the same way, a tire conveyor could be provided for the circulating guide section 7. In contrast, a chain conveyor, for example, could be provided in the region of the switchable guide elements S1-S4.

The circular cableway 1 can be operated in a first conveying operating mode in which exclusively the first conveying section F1 is used. The control unit 10 can actuate the actuating devices 11 of the first switchable guide element S1 and the second switchable guide element S2 in such a way that the switchable guide elements S1, S2 are each in the closed position. In addition, the actuating devices 11 of the third switchable guide element S3 and the fourth switchable guide element S4 can be actuated in such a way that the switchable guide elements S3, S4 are each in the (dashed) open position.

In the first conveying operating mode, the control unit 10 can activate the first drive device 13*a* of the first conveying section F1 and deactivate the second drive device 13*b* of the second conveying section F2. In addition, the control unit 10 can actuate the auxiliary drive in the first conveying operating mode in such a way that the cableway vehicles 4 decoupled from the first conveyor cable 2*a* of the first conveying section F1 can be moved from the first entry guide section 8*a* via a first part of the circulating guide section 7 to the first exit guide section 9*a* of the first conveying section F1. In the shown example, the first part of the circulating guide section 7 is formed by the first straight section 14*a*, the second curved section 7*b* and the second straight section 14*b*. The first entry guide section 8*a*, the first part of the circulating guide section 7, and the first exit guide section 9*a* together substantially form the first turning section W1 from FIG. 1.

This means that the control unit 10 preferably only activates the necessary part of the auxiliary drive that is required for the first conveying operating mode. In the above-mentioned embodiment of the auxiliary drive, this can mean, for example, that the tire conveyor of the first entry guide section 8*a*, the tire conveyor of the first exit guide section 9*a*, the tire conveyor of the circulating guide section 7, and the chain conveyor of the first and second switchable guide elements S1, S2 are activated. Optionally, only the part of the tire conveyor of the circulating guide section 7 required for movement along the first part of the circulating guide section 7 can also be active, in this case, for example, for moving along the first straight section 14*a*, the second curved section 7*b* and the second straight section 14*b*. The tire conveyor of the second entry guide section 8*b*, the tire conveyor of the second exit guide section 9*b*, and the chain conveyor of the third and fourth switchable guide elements S3, S4 (and optionally the unrequired part of the tire conveyor of the circulating guide section 7, in this case, for example, the first curved section 7*a*) can be deactivated by the control unit 10 in the first conveying operating mode.

The circular cableway 1 can also be operated in a second conveying operating mode in which exclusively the second conveying section F2 is used. In this case, the control unit 10 can actuate the actuating devices 11 of the third switchable guide element S3 and the fourth switchable guide element S4 in such a way that the switchable guide elements S3, S4 are each in the closed position. In addition, the actuating devices 11 of the first switchable guide element S1 and the second switchable guide element S2 can be actuated in such a way that the switchable guide elements S2, S3 are each in the (dashed) closed position.

In the second conveying operating mode, the control unit 10 can deactivate the first drive device 13*a* of the first conveying section F1 and activate the second drive device 13*b* of the second conveying section F2. In addition, the control unit 10 can actuate the auxiliary drive in the second conveying operating mode in such a way that the cableway vehicles 4 decoupled from the second conveyor cable 2*b* of the second conveying section F2 can be moved from the second entry guide section 8*b* via a second part of the circulating guide section 7 to the second exit guide section 9*b* of the second conveying section F2. In the shown example, the second part of the circulating guide section 7 is formed by the second straight section 14*b*, the first curved section 7*a* and the first straight section 14*a*. The second entry guide section 8*b*, the second part of the circulating guide section 7, and the second exit guide section 9*b* together therefore substantially form the second turning section W2 from FIG. 1. Again, preferably only the part of the auxiliary drive required for the second conveying operating mode can be activated, as has been described above with reference to the first conveying operating mode. So, there will be no repetition at this point.

Furthermore, the circular cableway 1 can also be operated in a third, fourth or fifth conveying operating mode described below, in which the two conveying sections F1, F2 are used. In the third conveying operating mode, the control unit 10 can actuate the actuating devices 11 of the four switchable guide elements S1-S4 in such a way that all switchable guide elements S1-S4 are in the closed position in each case. In the third conveying operating mode, the control unit 10 can activate the first drive device 13*a* of the first conveying section F1 and activate the second drive device 13*b* of the second conveying section F1.

In addition, the control unit 10 can actuate the auxiliary drive in the third conveying operating mode in such a way that the cableway vehicles 4 decoupled from the first conveyor cable 2*a* of the first conveying section F1 can be moved from the first entry guide section 8*a* via a third part of the circulating guide section 7 to the second exit guide section 9*b* of the second conveying section F2, and that the cableway vehicles 4 decoupled from the second conveyor cable 2*b* of the second conveying section F2 can be moved from the second entry guide section 8*b* via a fourth part of the circulating guide section 7 to the first exit guide section 9*a* of the first conveying section F1. In the shown example, the third part of the circulating guide section 7 is formed by the first straight section 14*a*, and the fourth part of the circulating guide section 7 is formed by the second straight section 14*b* in the shown example. The first straight section 14*a* therefore substantially forms the first passage guide section D1 from FIG. 1, and the second straight section 14*b* therefore substantially forms the second passage guide section D2 from FIG. 1. Again, preferably only the part of the auxiliary drive required for the third conveying operating mode can be activated, as has been described above with reference to the first conveying operating mode. No repetition will therefore be made at this point as well. In the third conveying operating mode, the first conveying section F1 and the second conveying section F2 are connected to one another, so that in each case, passage of the cableway vehicles 4 through the connecting station V is possible in a direction of travel. In the third conveying operating mode, the connecting station V therefore functions similarly to a conventional central station.

In the fourth conveying operating mode, the control unit 10 can actuate the actuating devices 11 of the first switchable guide element S1 and the second switchable guide element S2 in such a way that the first switchable guide element S1 and the second switchable guide element S2 are each in the closed position, analogously to the first and the third conveying operating mode. In contrast, the actuating devices 11 of the third switchable guide element S3 and the fourth switchable guide element S4 are controlled in the fourth conveying operating mode in such a way that the third switchable guide element S3 and the fourth switchable guide element S4 are each cyclically displaced between the closed position and the open position.

As a result, a plurality of consecutive cableway vehicles 4 can be moved by means of the first conveyor cable 2*a* into the entry area E1 of the first conveying section F1 and can be decoupled from the first conveyor cable 2*a* in the entry area E1 of the first conveying section F1. In the decoupled state, the cableway vehicles 4 can each be moved along the first entry guide section 8*a* via the first switchable guide element S1 in the closed position to the circulating guide section 7 and via the third part of the circulating guide section 7 (which is formed by the first straight section 14*a*) up to the fourth switchable guide element S4.

Depending on the switching pattern according to which the actuating device 11 of the fourth switchable guide element S4 is actuated by the control unit 10, a number (n) of consecutive cableway vehicles 4 can now alternatingly be moved to the second exit guide section 9*b* and further into the exit area A2 of the second conveying section F2 (if the fourth switchable guide element S4 is in the closed position), and a cableway vehicle 4 immediately following the number n of cableway vehicles 4 can be moved (when the fourth switchable guide element S4 is in the open position) via the first part of the circulating guide section 7 and via the second switchable guide element S2 in the closed position to the first exit guide section 9*a* of the first conveying section F1. In the shown example, the first part of the circulating guide section 7 is formed by the first straight section 14*a*, the second curved section 7*b* and the second straight section 14*b*.

The switching pattern of the actuating device 11 of the fourth switchable guide element S4 can thereby be defined in such a way that $n \in \mathbb{N}$ with $\mathbb{N} \geq 1$. When n=1, it means, for example, that a cableway vehicle 4 coming from the entry area E1 of the first conveying section F1 is conveyed into the exit area A2 of the second conveying section F2 (via the closed fourth switchable guide element S4), and the following cableway vehicle 4 coming from the entry area E1 of the first conveying section F1 is conveyed back into the exit area A1 of the first conveying section F1 (via the open fourth switchable guide element S4 and the closed second switchable guide element S2). As a result, the number of cableway vehicles 4 and consequently the conveying capacity can be doubled in the first conveying section F1 or halved in the second conveying section F2. Depending on how the number n is selected, different ratios can accordingly be set between the conveying capacity in the first conveying section F1 and the conveying capacity in the second conveying section F2. When n=2, for example, each third cableway vehicle 4 is returned to the first conveying section F1, when n=3, each fourth cableway vehicle 4, etc. The fourth conveying operating mode offers the advantage that both conveying sections F1, F2 can be operated simultaneously, and that the transport capacity can be adapted to the passenger volume of the particular conveying section F1, F2.

In the same way, the circular cableway 1 can be operated in a fifth conveying operating mode in which the actuating devices 11 of the third switchable guide element S3 and the fourth switchable guide element S4 are controlled in such a way that the third switchable guide element S3 and the fourth switchable guide element S4 are each in the closed position. The actuating devices 11 of the first switchable guide element S1 and the second switchable guide element S2 are in turn controlled in such a way that the first switchable guide element S1 and the second switchable guide element S2 are each cyclically displaced between the closed position and the open position.

As a result, a plurality of consecutive cableway vehicles 4 can be moved by means of the second conveyor cable 2*b* into the entry area E2 of the second conveying section F2 and decoupled from the second conveyor cable 2*b* in the entry area E2. In the decoupled state, the cableway vehicles 4 can each be moved along the second entry guide section 8*b* via the third switchable guide element S3 in the closed position to the circulating guide section 7 and via the fourth part of the circulating guide section 7 (which is formed by the second straight section 14*b*) up to the second switchable guide element S2.

Depending on the switching pattern according to which the actuating device 11 of the second switchable guide element S2 is actuated by the control unit 10, a number n of consecutive cableway vehicles 4 can now alternatingly be moved to the first exit guide section 9*a* and further into the exit area A1 of the first conveying section F1 (when the second switchable guide element S2 is in the closed position), and a cableway vehicle 4 immediately following the number n of cableway vehicles 4 can be moved (when the second switchable guide element S2 is in the open position) via the second part of the circulating guide section 7 and via the fourth switchable guide element S4 in the closed position to the second exit guide section 9*b* of the second conveying section F2. In the shown example, the second part of the circulating guide section 7 is formed by the second straight section 14*b*, the first curved section 7*a* and the first straight section 14*a*.

The switching pattern of the actuating device 11 of the fourth switchable guide element S4 can in turn be defined in such a way that $n \in \mathbb{N}$ with $\mathbb{N} \geq 1$. When n=1, this means that a cableway vehicle 4 coming from the entry area E2 of the second conveying section F2 is conveyed into the exit area A1 of the first conveying section F1 (via the closed second switchable guide element S2). The following cableway vehicle 4 coming from the entry area E2 of the second conveying section F2 can be conveyed back (via the open second switchable guide element S2 and the closed fourth switchable guide element S4) into the exit area A2 of the second conveying section F2. In the fifth conveying operating mode, the number of cableway vehicles 4 and consequently the conveying capacity can therefore be doubled in the second conveying section F2 or halved in the first conveying section F1. Depending on how the number n is selected, different ratios can in turn arise between the conveying capacity in the second conveying section F2 and the conveying capacity in the first conveying section F1. When n=2, for example, each third cableway vehicle 4 is returned to the second conveying section F2, when n=3, each fourth cableway vehicle 4, etc.

A suitable detection device (not shown) for detecting cableway vehicles 4 in certain sections of the connection guide device D can also be provided in the connecting station V. The detection device can communicate with the control unit 10 in a suitable manner and generate a sensor value representative of the presence of a cableway vehicle 4 and transmit it to the control unit 10. For example, the detection device can be designed to recognize a presence of cableway vehicles 4 on a switchable guide element S1-S4. This can prevent a switchable guide element S1-S4 from being actuated by the control unit 10 when a cableway vehicle 4 is currently located on the particular guide element S1-S4. Additionally or alternatively, the detection device can also be designed to detect a presence of cableway vehicles 4 in the direction of movement before a switchable guide element S1-S4, or in the direction of movement after a switchable guide element S1-S4. It is also possible to detect a cableway vehicle 4 in a certain region of the circulating guide section 7.

The detection device can, for example, have a number of sensors for detecting a presence of cableway vehicles 4 which are arranged at a suitable position of the connection guide device D. A proximity sensor can be used as a sensor, for example, which can detect the presence of a cableway vehicle 4 in a contactless manner. A proximity sensor can be designed, for example, as an inductive sensor, capacitive sensor, magnetic sensor, optical sensor, ultrasonic sensor or light barrier. A contact switch could also be used which detects the presence of a cableway vehicle 4, for example, in that the contact switch is actuated by a component of the cableway vehicle 4.

The use of a detection device is advantageous in particular for the fourth and fifth conveying operating mode because in this case, a cyclic opening and closing of the third guide element S3 and the fourth switchable guide element S4 (fourth conveying operating mode) or a cyclic opening and closing of the first guide element S1 and the second switchable guide element S2 (fifth conveying operating mode) takes place depending on the above-mentioned number n of cableway vehicles 4. The control unit 10 can use the sensor values generated by the detection device for controlling the actuating devices 11 of the switchable guide elements S1-S4.

For example, in the fourth conveying operating mode with a fixed number n (e.g. n=1), the control unit 10 can use the sensor values generated by the detection device to determine when the number n of cableway vehicles 4 has passed the fourth switchable guide element S4. For this purpose, for example, a sensor can be provided directly in the region of the fourth switchable guide element S4 or in the region of the second exit guide section 9*b* in the direction of movement after the fourth switchable guide element S4. After the number n cableway vehicles 4 has passed, the control unit 10 can actuate the actuating device 11 of the fourth switchable guide element S4 in order to displace the fourth switchable guide element S4 from the closed position into the open position.

Now the control unit 10 can use the sensor values generated by the detection device to determine when the at least one cableway vehicle 4 following the number n of cableway vehicles 4 has passed the branch from the circulating guide section 7 (here the first straight section 14*a*) to the fourth switchable guide element S4. For this purpose, for example, a sensor can be provided in the region of the circulating guide section 7 in the direction of movement after the branch, for example in FIG. 2 in the region of the second curved section 7*b*. After the at least one cableway vehicle 4 has passed, the control unit 10 can again actuate the actuating device 11 of the fourth switchable guide element S4 in order to displace the fourth switchable guide element S4 from the open position back into the closed position, etc.

Similarly, the third switchable guide element S3 can also be cyclically opened and closed depending on sensor values of the detection device in order to introduce the at least one cableway vehicle 4 between two consecutive cableway vehicles 4 which are moved from the entry area E2 of the second conveying section F2 to the exit area A1 of the first conveying section F1. For this purpose, for example, one or more suitable sensors can again be provided in the region of the third switchable guide element S3 and/or upstream in the direction of movement (for example in the region of the second entry guide section 8*b*) or downstream in the direction of movement (for example in the region of the second straight section 7*b*).

The same as was described for the fourth conveying operating mode naturally applies in the fifth conveying operating mode in an analogous manner for the actuation of the second switchable guide element S2 and the first switchable guide element S1. No repetition will therefore be made at this point.

Preferably, at least one sensor unit 12 for detecting a switching state is provided for each of the switchable guide elements S1-S4. The control unit 10 can then use the sensor values representative of the particular switching state for controlling the circular cableway 1. The operational safety can thereby be increased in that the operating modes are executed depending on the switching states. The sensor unit 12 is indicated merely by way of example for the fourth switchable guide element S4. Contrary to the shown arrangement on the guide element S4, the sensor unit 12 can of course also be arranged at another suitable location, for example on the first straight section 14*a* or in the region of the axis R. This substantially depends on the structural design of the sensor unit 12. The same naturally applies to all four guide elements S1-S4.

For example, the control unit 10 can operate the cableway 1 in the first conveying operating mode when the sensor units 12 provided for the first and second switchable guide elements S1, S2 each determine a sensor variable representative of the closed position, and the sensor units 12 provided for the third and fourth switchable guide elements S3, S4 each determine a sensor variable representative of the open position. In the same way, the control unit 10 can operate the circular cableway 1 in the second conveying operating mode when the sensor units 12 provided for the first and second switchable guide elements S1, S2 each determine a sensor variable representative of the open position, and the sensor units 12 provided for the third and fourth switchable guide elements S3, S4 each determine a sensor variable representative of the closed position. Furthermore, the control unit can operate the circular cableway 1 in the third conveying operating mode when the sensor units 12 of all four switchable guide elements S1-S4 each determine a sensor variable representative of the closed position.

The sensor units 12 can in this case each have a suitable sensor, for example an electrical switch, a displacement sensor, a proximity sensor, etc. The sensors can also use different measuring principles, for example inductive measurement, capacitive measurement, optical measurement, etc. The sensor units 12 can, for example, be connected to the control unit 10 via a suitable sensor line in order to transmit the sensor value. For the sake of simplicity, the sensor line is also only shown for the fourth switching element S4.

The cableway 1 according to the present disclosure can therefore be operated very flexibly in a desired operating mode, wherein the connecting station V can be designed to be significantly more compact than before.

The preferred embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

What is claimed is:

1. A circular cableway with a first conveying section which has a first conveyor cable, and with a second conveying section which has a second conveyor cable, and with a connecting station which connects the first and second conveying sections, wherein the first conveyor cable is deflected in the connecting station about a first cable sheave, and the second conveyor cable is deflected in the connecting station about a second cable sheave, wherein a plurality of cableway vehicles are provided which are movable by the first and second conveyor cables in the first and second conveying sections, wherein a connecting guide device is provided in the connecting station along which cableway vehicles decoupled from the first conveyor cable in an entry area of the first conveying section can be moved to an exit area of the first conveying section or to an exit area of the second conveying section, and along which cableway vehicles decoupled from the second conveyor cable in an entry area of the second conveying section can be moved to the exit area of the second conveying section or to the exit area of the first conveying section, comprising:

a circulating guide section in the connecting guide device that forms a closed conveyor loop along which the cableway vehicles can be moved;

a first switchable guide element displaceable between a closed position, connecting a first entry guide section of the connection guide device provided in the entry area of the first conveying section to the circulating guide section, and an open position;

a second switchable guide element displaceable between a closed position, connecting a first exit guide section of the connection guide device in the exit area of the first conveying section to the circulating guide section, and an open position;

a third switchable guide element displaceable between a closed position, connecting a second entry guide section of the connection guide section in the entry area of the second conveying section to the circulating guide section, and an open position; and a fourth switchable guide element displaceable between a closed position, connecting a second exit guide section of the connection guide device in the exit area of the second conveying section to the circulating guide section, and an open position.

2. The circular cableway according to claim 1, further comprising:

a control unit configured to control the circular cableway;

wherein each of the switchable guide elements comprises an actuating device configured to be actuated by the control unit to displace a respective switchable guide element between the closed position and the open position of the respective switchable guide element; and wherein each actuating device comprises at least one of a hydraulic cylinder, a pneumatic cylinder, and an electric motor.

3. The circular cableway according to claim 2, wherein the control unit comprises at least one of a first conveying operating mode, a second conveying operating mode, and a third operating mode, wherein the first conveying operating mode comprises:

actuating the respective actuating devices of the first switchable guide element and the second switchable guide element to place each of the first switchable guide element and the second switchable guide element in their respective closed positions; and actuating the respective actuating devices of the third switchable guide element and the fourth switchable guide element to place each of the third switchable guide element and the fourth switchable guide element in their respective open position;

wherein the second conveying operating mode comprises:

actuating the respective actuating devices of the first switchable guide element and the second switchable guide element to place each of the first switchable guide element in their respective open positions; and actuating the respective actuating devices of the third switchable guide element and the fourth switchable guide element to place each of the third switchable guide element and the fourth switchable guide element in their respective closed positions; and wherein the third conveying operating mode comprises actuating the actuating devices all of the switchable guide elements to place each of the switchable guide elements in their respective closed positions.

4. The circular cableway according to claim 3, wherein the control unit further comprises at least one of a fourth conveying operating mode and a fifth operating mode, wherein the fourth conveying operating mode comprises:

actuating the actuating devices of the first switchable guide element and the second switchable guide element to cyclically move each of the first switchable guide element and the second switchable guide element in their respective closed positions; and actuating the actuating devices of the third switchable guide element and the fourth switchable guide element to cyclically move the third switchable guide element and the fourth switchable guide element between their respective closed and open positions, alternatingly enabling a number (n) of consecutive cableway vehicles to be moved from the first conveying section via the fourth switchable guide element in the closed position into the exit area of the second conveying section, and at least one cableway vehicle immediately following the plurality of cableway vehicles to be moved along a part of the circulating guide section into the exit area of the first conveying section, wherein $n \in \mathbb{N}$ with $\mathbb{N} \geq 1$; and wherein the fifth conveying operating mode comprises:

actuating the actuating devices of the third switchable guide element and the fourth switchable guide element to place each of the third switchable guide element and the fourth switchable guide element in their respective closed positions; and actuating the actuating devices of the first switchable guide element and the second switchable guide element to cyclically move each of the first switchable guide element and the second switchable guide element between their respective closed and open positions, alternatingly enabling a number of sequential cableway vehicles to be moved from the second conveying section via the second switchable guide element in the closed position into the exit area of the first conveying section; and at least one cableway vehicle immediately following the number (n) of cableway vehicles moved along a part of the circulating guide section into the exit area of the second conveying section, wherein $n \in \mathbb{N}$ with $\mathbb{N} \geq 1$.

5. The circular cableway according to claim 3, further comprising:

a first drive device configured to drive the first conveyor cable of the first conveying section, and a second drive device is provided for driving the second conveyor cable of the second conveying section; and wherein the control unit is configured to one of:

activate the first drive device and to deactivate the second drive device in the first conveying operating mode, activate the second drive device and deactivate the first drive device, and to activate the first drive device and the second drive device in the third, fourth and fifth conveying operating modes.

6. The circular cableway according to claim 5, further comprising:

an auxiliary drive in the connecting station configured to move the cableway vehicles decoupled from the conveyor cables along the connection guide device, wherein the control unit is designed to actuate the auxiliary drive in the first conveying operating mode in such a way that the cableway vehicles decoupled from the first conveyor cable of the first conveying section are movable from the first entry guide section via a first part of the circulating guide section to the first exit guide section of the first conveying section, to actuate the auxiliary drive in the second conveying operating mode in such a way that the cableway vehicles decoupled from the second conveyor cable of the second conveying section can be moved from the second entry guide section via a second part of the circulating guide section to the second exit guide section of the second conveying section, and to actuate the auxiliary drive in the third conveying operating mode in such a way that the cableway vehicles decoupled from the first conveyor cable of the first conveying section can be moved from the first entry guide section via a third part of the circulating guide section to the second exit guide section of the second conveying section, and the cableway vehicles decoupled from the second conveyor cable of the second conveying section can be moved from the second entry guide section via a fourth part of the circulating guide section to the first exit guide section of the first conveying section.

7. The circular cableway according to claim 2, further comprising at least one sensor unit for detecting a switching state for each of the switchable guide elements;

wherein the control unit is configured to operate the circular cableway in the first conveying operating mode when the sensor units each determine a sensor variable representative of the respective closed position, and the sensor units provided for the third and fourth switchable guide elements each determine a sensor variable representative of the respective open position; and wherein the control is configured to operate the circular cableway in the second conveying operating mode when the sensor units for the first and second switchable guide elements each determine a sensor variable representative of the respective open positions, and the sensor units for the third and fourth switchable guide elements each determine a sensor variable representative of the respective closed position, and to operate in the third conveying operating mode when the sensor units of all four switchable guide elements each determine a sensor variable representative of the closed position.

8. The circular cableway according to claim 1, wherein the circulating guide section is circular, oval or elliptical.

9. The circular cableway according to claim 1, wherein the circulating guide section comprises a geometrically continuous curvature profile.

10. The circular cableway according to claim 1, wherein the circulating guide section comprises:

a first curved section and an opposite second curved section, wherein a convex side of the first curved section faces the first conveying section, and wherein a convex side of the second curved section faces the second conveying section.

11. The circular cableway according to claim 10, wherein the circulating guide section comprises a first straight section and an opposite, parallel second straight section which connect the first and second curved sections forming the closed conveying loop, and wherein the first switchable guide element and the fourth switchable guide element are connected to the first straight section in their respective closed positions, and the second switchable guide element and the third switchable guide element are connected to the second straight section in their respective closed positions.

12. The circular cableway according to claim 10, wherein the curved sections each comprise circular arc sections.

13. The circular cableway according to claim 1, wherein the switchable guide elements are each connected with the associated entry guide section or with the associated exit guide section and pivotable about an axis.

14. A method for operating a circulating cableway according to claim 1, comprising the steps of:

in a first conveying mode, activating a first drive of the cableway vehicles in the first conveying section and deactivating a second drive of the cableway vehicles in the second conveying section;

moving at least one cableway vehicle into the entry area of the first conveying section with the first conveyor cable;

decoupling the at least one cableway vehicle from the first conveyor cable in the entry area of the first conveying section;

while decoupled, moving the at least one cableway vehicle along the first entry guide section via the first switchable guide element in the closed position to the circulating guide section;

moving the at least one cableway vehicle via a first part of the circulating guide section;

moving the at least one cableway vehicle via the second switchable guide element in the closed position and the first exit guide section into the exit area of the first conveying section; and coupling the at least one cableway vehicle to the first conveyor cable in the exit area of the first conveying section.

15. The method for operating a circular cableway according to claim 14, further comprising the steps of:

in a second conveying operating mode, activating the second drive and deactivating the first;

moving the at least one cableway vehicle into the entry area of the second conveying section with the second conveyor cable;

decoupling the at least one cableway vehicle from the second conveyor cable in the entry area of the second conveying section;

while decoupled, moving the at least one cableway vehicle along the second entry guide section via the third switchable guide element in the closed position to the circulating guide section;

moving the at least one cableway vehicle along via a second part of the circulating guide section;

moving the at least one cableway vehicle via the fourth switchable guide element in the closed position and the second exit guide section into the exit area of the second conveying section; and coupling the at least one cableway vehicle to the second conveyor cable in the exit area of the second conveying section.

16. The method for operating a circular cableway according to claim 15, further comprising the steps of:

in a third conveying operating mode, activating the first drive and deactivating the second drive;

moving the at least one cableway vehicle into the entry area of the first conveying section with the first conveyor cable;

decoupling the at least one cableway vehicle from the first conveyor cable in the entry area of the first conveying section;

while decoupled, moving the at least one cableway vehicle along the first entry guide section via the first switchable guide element in the closed position to the circulating guide section;

moving the at least one cableway vehicle via a third part of the circulating guide section;

moving the at least one cableway vehicle via the fourth switchable guide element in the closed position and the second exit guide section into the exit area of the second conveying section;

coupling the at least one cableway vehicle to the second conveyor cable in the exit area of the second conveying section;

moving the at least one cableway vehicle into the entry area of the second conveying section with the second conveyor cable;

decoupling the at least one cableway vehicle from the second conveyor cable in the entry area of the second conveying section;

while decoupled, moving the at least one cableway vehicle along the second entry guide section via the third switchable guide element in the closed position to the circulating guide section;

moving the at least one cableway vehicle via a fourth part of the circulating guide section;

moving the at least one cableway vehicle via the second switchable guide element in the closed position and the first exit guide section into the exit area of the first conveying section; and coupling the at least one cableway vehicle to the first conveyor cable in the exit area of the first conveying section.

17. The method for operating a circular cableway according to claim 16, further comprising the steps of:

in a fourth conveying operating mode, activating the first drive and activating the second drive;

moving a plurality of consecutive cableway vehicles into the entry area of the first conveying section with the first conveyor cable;

decoupling the plurality of consecutive cableway vehicles from the first conveyor cable in the entry area of the first conveying section;

while decoupled, moving the plurality of consecutive cableway vehicles along the first entry guide section via the first switchable guide element in the closed position to the circulating guide section;

moving the plurality of consecutive cableway vehicles via a third part of the circulating guide section;

alternatingly moving a number (n) of consecutive cableway vehicles of the plurality of cableway vehicles, where $n \in \mathbb{N}$ with $\mathbb{N} \geq 1$, via the fourth switchable guide element in the closed position and the second exit guide section into the exit area of the second conveying section;

coupling the number of consecutive cableway vehicles to the second conveyor cable in the exit area of the second conveying section;

moving at least one cableway vehicle immediately following the number (n) of cableway vehicles via a first part of the circulating guide section;

moving the at least one cableway vehicle via the second switchable guide element in the closed position and the first exit guide section into the exit area of the first conveying section; and coupling the at least one cableway vehicle to the first conveyor cable in the exit area of the first conveying section.

18. The method for operating a circular cableway according to claim 17, further comprising the steps of:

in a fifth conveying operating mode, activating the first drive and activating the second drive;

moving a plurality of consecutive cableway vehicles into the entry area of the second conveying section with the second conveyor cable;

decoupling the plurality of consecutive cableway vehicles from the second conveyor cable in the entry area of the second conveying section;

while decoupled, moving the plurality of consecutive cableway vehicles along the second entry guide section via the third switchable guide element in the closed position to the circulating guide section;

moving the plurality of consecutive cableway vehicles via a fourth part of the circulating guide section;

alternatingly moving a number (n) of consecutive cableway vehicles of the plurality of cableway vehicles via the second switchable guide element in the closed position and the first exit guide section into the exit area of the first conveying section;

coupling the number (n) of consecutive cableway vehicles to the first conveyor cable in the exit area of the first conveying section;

moving at least one cableway vehicle immediately following the number (n) of cableway vehicles via a second part of the circulating guide section;

moving the at least one cableway vehicle via the fourth switchable guide element in the closed position and the second exit guide section into the exit area of the second conveying section; and coupling the at least one cableway vehicle to the second conveyor cable in the exit area of the second conveying section, where $n \in \mathbb{N}$ with $\mathbb{N} \geq 1$.

19. The method according to claim 18, further comprising the step of introducing the at least one cableway vehicle between two consecutive cableway vehicles which are moved from the entry area of the second conveying section to the exit area of the first conveying section.

20. The method according to claim 19, wherein at least one of:

the first part of the circulating guide section comprises at least the first straight section, the second curved section, and the second straight section, and the second part of the circulating guide section comprises the second straight section, the first curved section, and the first straight section, and the third part of the circulating guide section comprises the first straight section, and the fourth part of the circulating guide section comprises the second straight section.

21. The method according to claim 18, further comprising the step of introducing the at least one cableway vehicle between two consecutive cableway vehicles which are moved from the entry area of the first conveying section to the exit area of the second conveying section.

* * * * *